US010048047B2

(12) United States Patent
Van Niekerk et al.

(10) Patent No.: US 10,048,047 B2
(45) Date of Patent: Aug. 14, 2018

(54) EXPLOSIVE BOOSTER

(71) Applicant: Alba Manufacturing Corp, Manati, PR (US)

(72) Inventors: Albert Petrus Van Niekerk, Jacksonville, FL (US); Adriaan Johannes Goosen, Guaynabo, PR (US)

(73) Assignee: Alba Manufacturing Corp., Manati, PR (US)

( * ) Notice: Subject to any disclaimer, the term of this patent is extended or adjusted under 35 U.S.C. 154(b) by 0 days.

(21) Appl. No.: 15/501,661

(22) PCT Filed: Aug. 6, 2015

(86) PCT No.: PCT/IB2015/055976

§ 371 (c)(1),
(2) Date: Feb. 3, 2017

(87) PCT Pub. No.: WO2016/020875

PCT Pub. Date: Feb. 11, 2016

(65) Prior Publication Data

US 2017/0227340 A1 Aug. 10, 2017

(30) Foreign Application Priority Data

Aug. 6, 2014 (ZA) ..... 2014/05775

(51) Int. Cl.
*F42B 1/04* (2006.01)
*F42C 19/09* (2006.01)
(Continued)

(52) U.S. Cl.
CPC ..... *F42B 1/04* (2013.01); *F42B 1/024* (2013.01); *F42B 3/22* (2013.01); *F42B 3/26* (2013.01); *F42C 19/09* (2013.01)

(58) Field of Classification Search
CPC ..... F42B 1/024; F42B 1/04; F42C 19/09
See application file for complete search history.

(56) References Cited

U.S. PATENT DOCUMENTS 2,604,042 A 7/1952 Cook
3,100,445 A 8/1963 Poulter
(Continued)

FOREIGN PATENT DOCUMENTS

FR 2216544 A1 * 8/1974 ..... F42B 1/024
FR 2792717 A1 * 10/2000 ..... E21B 43/117
(Continued)

OTHER PUBLICATIONS

Machine translation of FR-2216544-A1, European Patent Office.*
(Continued)

*Primary Examiner* — Stephen Johnson
*Assistant Examiner* — Joshua T Semick
(74) *Attorney, Agent, or Firm* — Andrus Intellectual Property Law, LLP

(57) ABSTRACT

An explosive booster shaped to fit into a blasthole adjacent a main explosive charge is provided. The booster comprises a body containing a charge of an explosive substance with a passage extending inwardly of the body to receive a detonator therein. The booster is configured to alter the shape of a detonation wave generated upon initiation of the detonator. In an embodiment, the booster includes a first and a second explosive substance, with the first explosive substance being shaped and selected to cause an outer portion of the detonation wave to accelerate relative to the remainder of the wave thereby altering the shape of the wave from a generally spherical wave to a generally planar wave. In an embodiment, the booster includes an internal member capable of altering the shape of the detonation wave.

14 Claims, 4 Drawing Sheets

(51) Int. Cl.

| | |
|---|---|
| ***F42B 3/26*** | (2006.01) |
| ***F42B 3/22*** | (2006.01) |
| ***F42B 1/024*** | (2006.01) |

(56) References Cited

U.S. PATENT DOCUMENTS

| | | | | | |
|---|---|---|---|---|---|
| 3,561,361 | A * | 2/1971 | Kessenich | F42B 1/024 | 102/307 |
| 3,658,007 | A * | 4/1972 | Bucklisch | F42B 1/024 | 102/306 |
| 3,736,875 | A * | 6/1973 | Bucklishch | F42B 1/024 | 102/309 |
| 4,665,826 | A * | 5/1987 | Marer | F42B 1/02 | 102/401 |
| 4,672,896 | A * | 6/1987 | Precoul | F42B 1/024 | 102/309 |
| 4,729,318 | A | 3/1988 | Marsh | | |
| 4,829,901 | A * | 5/1989 | Yates, Jr. | F42B 1/024 | 102/306 |
| 4,942,819 | A * | 7/1990 | Thoma | F42B 1/024 | 102/307 |
| 5,204,493 | A | 4/1993 | Christmann et al. | | |
| 5,322,020 | A * | 6/1994 | Bernard | F42B 1/024 | 102/306 |
| 5,565,644 | A | 10/1996 | Chawla | | |
| 8,056,478 | B2 * | 11/2011 | Berlin | F42B 3/22 | 102/202 |
| 9,163,914 | B2 * | 10/2015 | Carton | B26F 3/04 | |

FOREIGN PATENT DOCUMENTS

| | | | | |
|---|---|---|---|---|
| GB | 2138111 | | 10/1984 | |
| WO | 99/53264 | A1 | 10/1999 | |
| WO | WO-2013059845 | A1 * | 4/2013 | F42B 3/02 |

OTHER PUBLICATIONS

International Search Report for International Patent Application No. PCT/IB2015/055976 dated Feb. 16, 2016.

Written Opinion for International Patent Application No. PCT/IB2015/055976 dated Feb. 16, 2016.

Examination Report for Australian Patent Application No. 2015300680 dated Feb. 17, 2017.

* cited by examiner

EXPLOSIVE BOOSTER

CROSS-REFERENCE(S) TO RELATED APPLICATIONS

This application is the U.S. national stage application of International Application PCT/IB2015/055976, filed Aug. 6, 2015, which international application was published on Feb. 11, 2016, as International Publication WO 2016/020875 A3 in the English language. The International Application claims priority of South African Patent Application 2014/05775, filed Aug. 6, 2014.

TECHNICAL FIELD

This disclosure relates to explosives and, more particularly, it relates to explosive boosters for initiating a secondary main explosive charge.

TECHNICAL BACKGROUND

In order to provide for safety consideration of conventional explosives used for open cast or strip mining, quarry blasting or construction blasting, such explosives typically comprise explosive compounds which are insensitive to initiation by a detonator. In order to be capable of initiating the explosive material, a principle known as the "explosives train" is employed, wherein energy released by a detonator is transferred to an intermediate charge or "booster", which is sufficiently sensitive to be initiated by the detonator, and which then amplifies the energy so as to initiate the explosive compound of the main charge or blasting agent.

Various boosters have been proposed in the prior art and generally comprise an elongate hollow body, typically of a plastics or cardboard material, which is filled with an explosive material that is more sensitive than that of the main charge. The body commonly includes an appropriate formation, also known as a detonator well, for receiving a detonator such that the detonator is positioned appropriately so as to ensure reliable initiation of the explosives material of the booster.

Effectiveness of explosives is largely dependent on the rate at which the potential energy contained in the explosive material can be released. Thus, in order for an explosive to function optimally, a maximum amount of explosive material should be initiated in the shortest possible time.

The manner in which a detonation wave initiates explosive material can be tailored. U.S. Pat. No. 2,604,042 describes a method of converting a point source shock wave into a plane wave by tailoring the shape of the explosive material so that it is cone-shaped. The method involves machining the explosive material into shape. Complicated and costly machinery is necessary to ensure safety during the machining of the explosive material.

A similar cone-shaped arrangement of explosives is described in PCT International Publication number WO99/53264. A booster is described which includes two explosive charges, wherein the first explosive charge is sensitive to ignition and the second explosive charge is less sensitive to ignition. The booster is ice-cream cone-shaped which shapes the shock wave.

U.S. Pat. No. 4,729,318 describes an explosive plane-wave air lens which uses a disc-shaped impactor that spans between donor and acceptor explosives with different detonation velocities to convert a detonation wave from one wave form to another.

In this specification, "detonator" shall have its widest meaning and shall include any suitable form of initiation commonly used for commercial blasting including, but not limited to, non-electric detonators such as shock tube detonators or fuse caps, electric detonators such as instantaneous electrical detonators (IED) or exploding foil detonators (EFI), and electronic detonators.

Further, "detonation cable" shall have the widest meaning and shall include any suitable means of transmitting a detonating signal to the detonator, including, but not limited to, detonation cord, electronic or electric wire, shock tube, optic fibre cable, electric conductor and the like.

SUMMARY

In accordance with the technology there is provided an explosives booster shaped to fit into a blasthole in close proximity to a main explosive charge, the booster comprising a body which includes an explosive substance and is configured to receive a detonator for initiating the explosive substance, characterized in that a non-explosive member is provided internally of the explosive substance, the member being configured to alter the shape of a detonation wave travelling therethrough.

A further feature provides for the non-explosive member to have a frusto-conical shape.

Further features provide for the body to be generally cylindrical in shape; for the body to include a tube having a blind first end with a closure provided at an opposite second end; for the body to include a passage that extends inwardly from one of the ends and which is configured to receive the detonator; for the passage to extend centrally into the body; and for a channel to be provided externally of the explosive substance which spans the length of the body and which is configured to receive a detonation cable therein.

Still further features provide for the first explosive substance to include pentolite, plastic explosive (C4), octogen (HMX), pentaerythritol tetranitrate (PETN), trinitrotoluene (TNT), cyclotrimethylenetrinitramine (RDX) or combinations thereof and the like; and for the explosive substance to include a suitable ammonium nitrate explosive including a watergel or slurry explosive, an emulsion explosive, prilled or crystalline ammonium nitrate, liquid ammonium nitrate, any one of the above which includes an additive such as diesel, oil, a suitable surfactant, liquid or solid molecular explosives, microballoons in the form of encapsulated gas or gas bubbles, and any combinations thereof and the like.

A further feature provides for the non-explosive member to be configured to alter the shape of the detonation wave by decelerating a central portion of the detonation wave relative to the remainder of the wave so as to alter the wave from a generally spherical wave to a generally planar wave.

Further features provide for the non-explosive member to be made from a non-explosive material; for the non-explosive material to include any suitable material capable of decelerating the detonation wave passing therethrough, including high density polymers, low density polymers such as expanded polystyrene, bound plastic or glass microballoons, metal, wood, a body defining a hollow void therein, and the like; for the non-explosive member to be located centrally within the body; for spacing means to be provided to space the member from an end of the body; and for the spacing means to include a set of legs extending from the non-explosive member and configured to space the member from an end of the body.

BRIEF DESCRIPTION OF THE DRAWINGS

The technology will now be described, by way of example only with reference to the accompanying representations in which.

DETAILED DESCRIPTION WITH REFERENCE TO THE DRAWINGS

Figure 1:
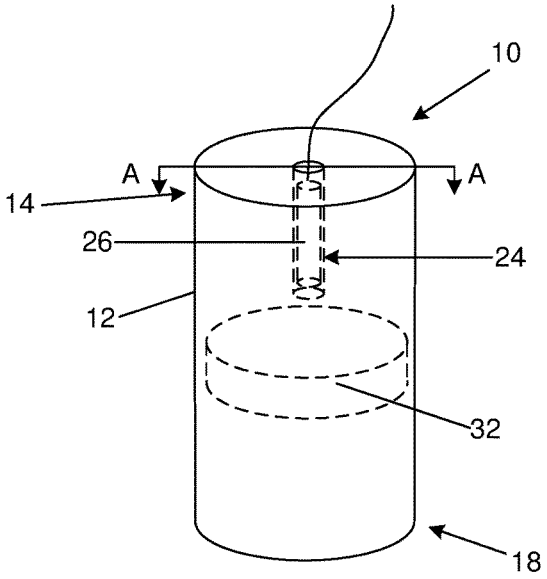
FIG. 1 is a three-dimensional view of an embodiment of an explosives booster.

Embodiments described herein provide an explosive booster which may be used as a bridge between a conventional detonator and a main explosive charge having a relatively low sensitivity to initiation. The main explosive charge may include any suitable charge commonly used in commercial blasting and may include, but is not limited thereto, ammonium nitrate-fuel oil (ANFO), emulsion explosives and mixtures thereof, watergels or slurry explosives, trinitrotoluene (TNT), nitrocellulose, nitroglycerine and the like.

Boosters are typically placed at the bottom of a blasthole, the booster may be surrounded by dust from the drilling process or water, mud or debris all of which have a detrimental influence on the initial detonation of the charge. It is therefore essential that the maximum explosive output of the booster is achieved so as to ensure that the booster is capable of initiating the main explosive charge as efficiently as possible as the location of booster placement.

Customary cast boosters such as pentolite boosters overcome these drawbacks due to the high detonation pressure of the pentolite explosive relative to that of the main explosive charge. However, in some markets, pentolite boosters are typically expensive or are not readily available due to regulatory restrictions which may inhibit readily sourcing thereof, or their storage, distribution and generally their use. In such cases, emulsion or boosters comprising a binary explosive, often referred to as two component boosters, are commonly used. Nevertheless, since the booster is initiated by a generally spherical detonation wave generated by the detonator, the booster will generate a generally spherical detonation wave which is typically of relatively low intensity. This results in a slow or inefficient initiation of the main explosive charge. Furthermore, with currently available two component boosters, this effect is further pronounced due to side initiation of the main booster charge by the detonator. In addition, the detonation pressure of two component boosters is also typically fairly low.

Embodiments of the explosive booster herein may provide a number of advantages over two part or emulsion boosters. For example, by altering the shape of the detonation wave from a generally spherical to a generally planar wave, the output of the booster is made significantly more efficient due to the planar wave initiating the main charge over a wider surface. This ensures that a steady planar detonation wave transitions from the booster to the main explosive charge, thereby reducing the run-up distance, thus resulting in a faster steady detonation of the main charge. This will have the effect that the overall energy release from the main explosive charge is improved when compared to using currently available emulsion or two-part booster of the same weight. Alternatively, the detonation is focused on a central point or axis, which results in overdrive of the main explosive charge thereby causing the main explosive charge to fully detonate within a short period of time.

Figure 2:
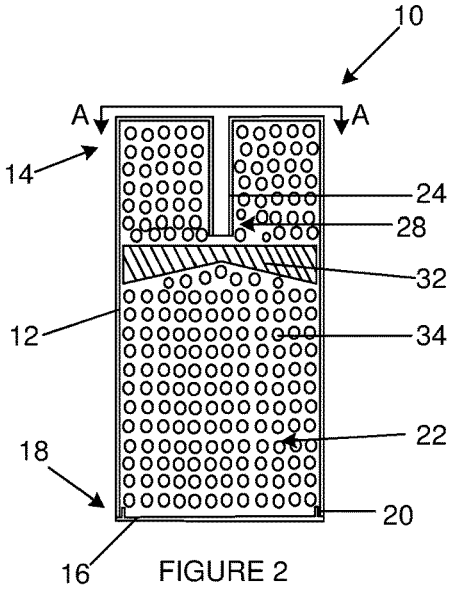
FIG. 2 is a longitudinal sectional view of the explosive booster of FIG. 1 along the line A-A.

FIGS. 1 and 2 illustrate an embodiment of an explosives booster (10) in accordance with the technology. The booster (10) has a cylindrical body (12) having a blind first end (14) with a closure (16) provided at an opposite second end (18). The closure (16) includes a skirt (20) which secures to the body (12) by means of a friction fit. However, it will be appreciated that any suitable attachment arrangement to secure the closure (16) to the body (12) may be used, including a screw thread arrangement, a bayonet fitting, a rib and groove type arrangement for a snap fit or an adhesive. The body (12) and closure (16) are preferably manufactured from a cardboard type material or a plastics material such as polyvinyl chloride (PVC), high-density polyethylene (HDPE) or polypropylene, but any suitable material may be used.

The body (12) includes an explosive substance (22) which is introduced into the body (12) prior to securing the closure (16) thereto. In addition, the body (12) includes a passage (24) which extends into the body (12) from the first end (14) and is surrounded by the explosive substance (22). Of course, the passage may also extend from the closure. The passage (24) is shaped to receive a detonator (26) therein for initiating the explosive substance (22).

The free or output end (28) of the passage (24) is closed so as to ensure that the explosive substance (22) does not spill out during filling of the body (12). The passage (24) and body (12) are integrally formed, however, it will be appreciated that the free end (28) of the passage (24) could also be open and then closed prior to filling the body (12) by securing a lid or cap (28) over the free end (28) of the passage (24). The cap may then be secured to the free end (28) by an adhesive or other suitable means. In addition, the thickness of the passage and cap, if appropriate, is selected such that the detonation wave generated by the detonator can easily penetrate so as to ensure efficient initiation of the explosive substance in the booster.

In the embodiment illustrated in FIGS. 1 and 2, the explosive substance (22) comprises a first explosive substance (32) and a second explosive substance (34). The first explosive substance (32) is selected to have different explosive properties, such as a higher velocity of detonation (VOD), a higher brisance or a higher density, to the second explosive substance (34).

The first explosive substance (32) may include pentolite, plastic explosive (e.g. C4), octogen (HMX), pentaerythritol tetranitrate (PETN), trinitrotoluence (TNT) or the like. The second explosive substance (34), on the other hand, may include any suitable ammonium nitrate explosive including, but not limited to, a watergel explosive, an emulsion explosive, crystalline ammonium nitrate, preferably prilled crystalline ammonium nitrate, liquid ammonium nitrate, or any one of the above which includes an additive such as diesel, oil, a suitable surfactant such as sulfonates or amines, liquid or solid molecular explosives, microballoons or any combinations thereof and the like.

It will be appreciated that since the first explosive substance (32) is selected to have different explosive properties than the second explosive substance (34), initiation of the first explosive substance (32) will be at a higher rate than of the second explosive substance (34). The significance thereof will be described in more detail further below.

The first explosive substance (32) is located in close proximity to the free end (28) of the passage (24) to ensure that it is initiated shortly after initiation of the detonator (26). In this regard, retaining means may be provided to retain the first explosive substance (32) at a desired location within the body (12) during filling thereof with the second explosive substance (34). Furthermore, the first explosive substance (32) is shaped to define a hollow therein which ensures that, once initiated, the detonation wave thereof spreads evenly across the entire cross-sectional area of the body (12). In addition, since the hollow will be filled with the secondary explosive substance (34), once the detonation wave reaches the hollow, the central portion thereof will decelerate due to the different explosive properties of the second explosive substance, with the outer portions travelling at the same velocity and gradually decreasing as the remaining portions reach the secondary explosive substance (34). This effectively permits the outer portions of the detonation wave to catch up with the central portion, thereby altering the shape of the detonation wave from generally spherical to generally planar.

The weight of the booster (10) may be in the range of about 50 grams to about 2 kilograms, preferably in the range of about 50 grams to about 500 grams.

Figure 3:
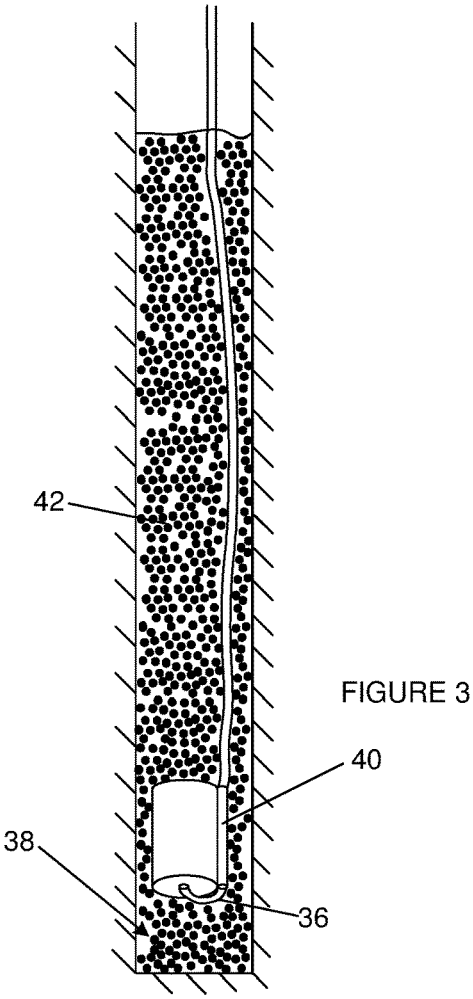
FIG. 3 illustrates the booster of FIG. 1 being used in a blasthole with a main explosives charge.

In use, and as illustrated in FIG. 3, a detonator (26) attached to a detonation cable (36) is inserted into the passage (24) of the booster (10), and the booster (10) is then inserted into a blasthole (38). The booster (10) is inserted into the blasthole (38) with closure (16) or output end facing upwardly toward the bulk of the main explosive charge (42) as will be described in more detail further below. Since the booster (10) is inserted into the blasthole (38) with the detonator (26) being in the bottom of the hole (38), the detonation cable (36) is bent upwardly and extends along the outside surface of the booster (10). During insertion of the booster (10) into the blasthole (38), the booster (10) may need to be pushed downwardly or inwardly, as the case may be, by means of a rod or the like and since the detonation cable (36) extends along the outer surface of the booster (10), the cable (36) may be damaged while pushing the booster (10) into the hole. In order to ensure that the detonation cable (36) is not damaged, the booster (10) may include a channel, sleeve or tube (40) externally of the body (12) and through which the detonation cable (36) may pass. The channel or sleeve (40) will protect the detonation cable (36) from being damaged during insertion of the booster (10) into the blasthole (38). Of course, the channel or tube may also be internally of the body or in any other suitable manner to ensure that the detonation cable is not damaged during insertion of the booster into the blasthole, provided that the channel (40) should be separate from the explosive substance (22) so as to ensure that it does not interfere with the detonation wave or otherwise negatively affect the energy output of the booster through interference of partial sympathetic initiation.

Once the booster (10) has been inserted into the blasthole (38), a main explosive charge (42), typically in a flowable form, is introduced into the blasthole (38). It will of course be appreciated that the main explosive charge may also be in the form or a cartridge or semi-liquid or free flowing crystalline explosive. The detonator (26) is then initiated by means of the detonation cable (36) and generates a detonation wave having a generally spherical shape around the detonator base charge. The detonation wave penetrates the passage (24) and then initiates the first explosive substance (32). Since the first substance (32) is selected to either have a higher VOD or higher brisance than the second substance (34), it detonates at a greater rate than the second substance (30).

This increased rate of detonation as well as the shape of the first explosive substance (32), causes the detonation wave to rapidly spread across the entire cross-sectional area of the body (12) as well as affectively accelerate the outer portion of the wave relative to the central portion thus changing the shape or geometry of the wave from a generally spherical wave to generally planar wave. The planar shaped detonation wave subsequently initiates the remainder of the second substance (34) across the entire cross-sectional area of the body (12) and subsequently initiates the main explosive charge (42).

It will be appreciated that the generally planar detonation wave generated by the first substance (32) will substantially increase the area of the detonation wave as well as the VOD thereby increasing the overall explosive output of the booster (10). This increased explosive output provides for an increased rate and efficiency at which the potential energy of the explosive substance (22) can be released and transferred to the main explosive charge (42), and thus improves the detonation performance of the booster (10).

Figure 4:
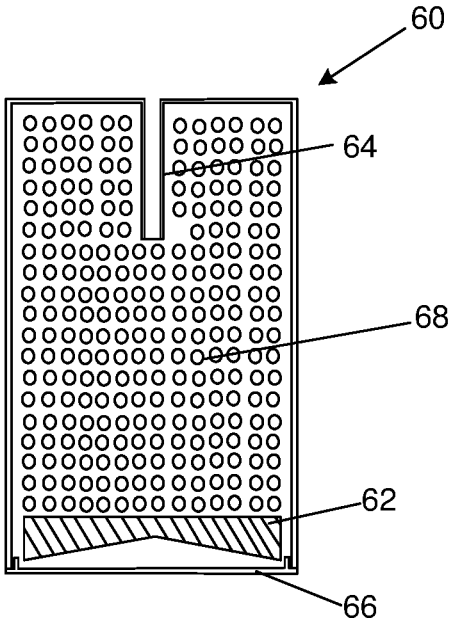
FIG. 4 is a longitudinal sectional view of a further embodiment of an explosive booster.

FIG. 4 illustrates a further embodiment of an explosive booster (60) in accordance with the technology. The booster (60) is similar to the booster (10) illustrated in FIGS. 1 and 2, except that in this embodiment the first explosive substance (62) is located remote from the passage (64) and preferably adjacent the closure (66). Initiation of the detonator will again generate a generally spherical detonation wave, which penetrates the passage (64) and initiates the second explosive substance (68). The second explosive substance (68) initiates as it is reached by the detonation wave generated by the detonator and generates a detonation wave having a generally spherical shape.

When the detonation wave reaches the first explosive substance (62), the rate of initiation will increase causing the wave to rapidly spread across the entire cross-sectional area of the booster (60). In addition, due to the shape of the first explosive substance, the central portion of the wave will decelerate relative to the outer portion, thereby altering the shape of the wave from generally spherical to generally planar extending over the entire cross-sectional area of the booster (60).

It will be appreciated that the high rate of initiation as well as detonation of the explosive substance across the entire cross-sectional area of the booster (60) will significantly improve the output of the booster (60) when compared to a booster which does not include a charge similar to the first explosive substance (62). This will again result in a more efficient energy impartation to the main explosive charge in the blasthole.

Figure 5:
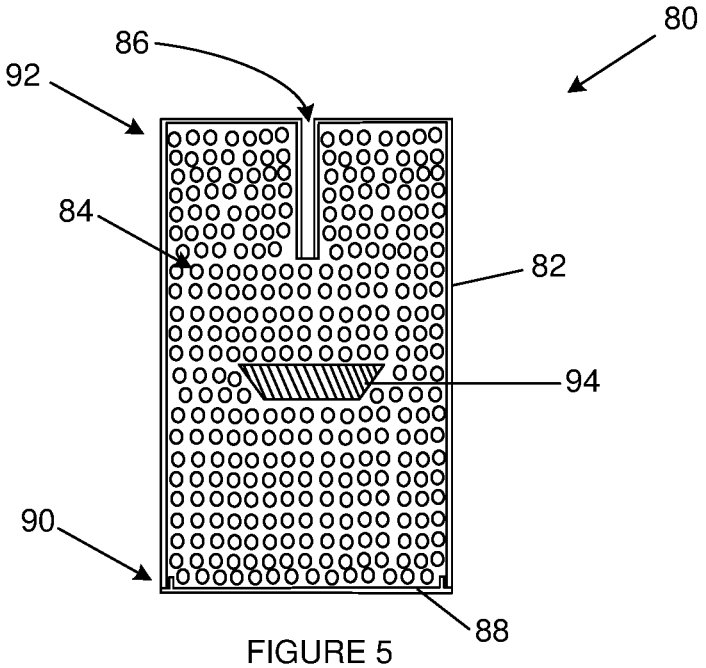
FIG. 5 is a longitudinal sectional view of still a further embodiment of an explosive booster.

FIG. 5 illustrates still a further embodiment of an explosive booster (80) in accordance with the technology. The booster (80) again has a cylindrical body (82) that contains an explosive substance (84) and includes an inwardly extending passage (86) into which a detonator (not shown) can be inserted. Similarly to the previous embodiments, a closure (88) is provided at an end (90) opposite the end (92) from which the passage (86) extends.

The booster (80) further includes an internal member (94) having a frusto-conical shape and which is manufactured from any suitable non-explosive material that is capable of decelerating a detonation wave passing therethrough, as will be described further below. As such, the internal member (94) may be manufactured from high density polymers, low density polymers such as expanded polystyrene, bound plastic or glass microballoons, any suitable metal, wood or the like. In addition, in some embodiments, the internal member (94) may also simply be a thin walled hollow body in which the cavity is simply filled with air, thus being manufactured from one of the above materials with a hollow cavity.

The internal member (94) is spaced from the passage (86) by a distance dependent on the shape, size and material used for the internal member (94). Any suitable means of spacing the internal member within the body of the booster may be employed, as will be described in more detail further below, but the body may also simply be partially filled with the explosive substance, the internal member then place into or onto the substance, and then the remainder of the body filled.

Figure 6:
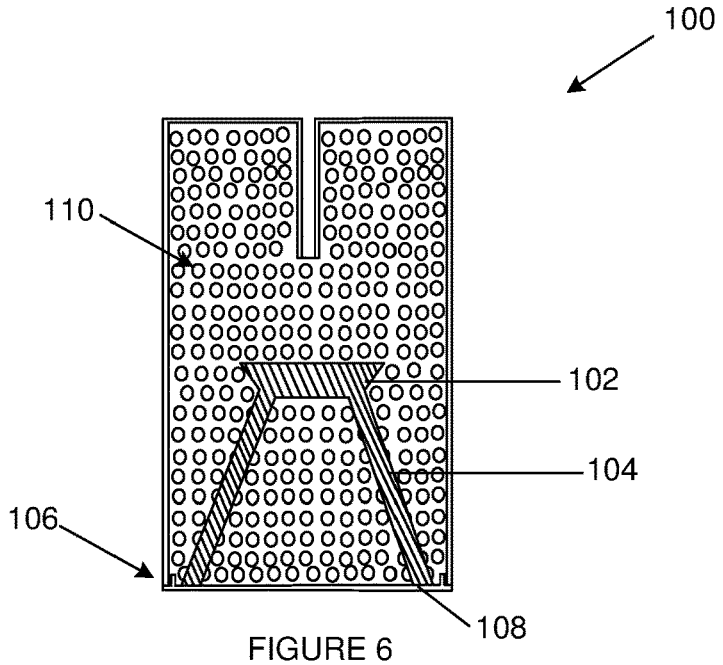
FIG. 6 is a longitudinal sectional view of yet a further embodiment of an explosive booster.
Figure 7:
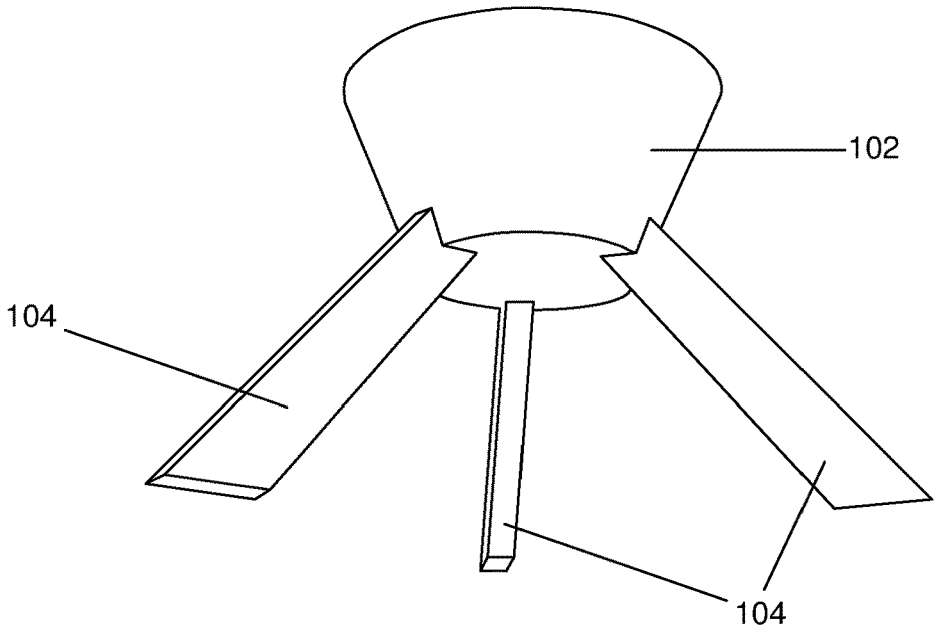
FIG. 7 is a three-dimensional view of one embodiment of an internal member of the booster illustrated in FIG. 6.

FIG. 6 illustrates yet a further embodiment of an explosives booster (100) in accordance with the technology. The booster (100) is substantially similar to the booster (80) illustrated in FIG. 5, provided that in this embodiment, the internal member (102) includes a set of legs (104) to effectively space the internal member from the end (106) to which the closure (108) is secured. In this embodiment, and as best illustrated in FIG. 7, the internal member (102) includes three legs (104).

Applicant has found that the use of legs (104) works particularly well to ensure that the internal member (102) is appropriately spaced, however, it will be appreciated that any other suitable means could be used. For example, a ring which engages inner surfaces of the body in a friction fit and which includes a number of protrusions to connect the internal member to the ring could also be used. Alternatively, a further tube which fits into the body and includes similar protrusions to hold the internal member could also be used. It will of course also be appreciated that the internal member may be manufactured integrally with the body.

Upon initiation of the detonator, the detonator will generate a generally spherical detonation wave. This detonation wave then proceeds to initiate the explosive substance (110), which will also generate a detonation wave being generally spherical in shape. When the detonation wave reaches the internal member (102), the portion of the wave travelling through the internal member (102), thus the central portion, will be decelerated with respect to the remainder of the detonation wave generated by the explosive substance (110). Thus, the central portion of the detonation wave, or shock wave resulting from the detonation wave, is decelerated while the remainder of the detonation wave continues at its normal velocity of detonation (VOD). Selecting the shape, material and spacing of the internal member (102) relative to the detonator correctly, permits the shape of the detonation wave or Shock wave, as the case may be, to be altered from generally spherical to generally planar across the axial cross-sectional area of the booster (100). Once the detonation wave has been altered to a generally planar wave, the remainder of the explosive substance (110) continues to initiate across the entire cross-sectional area of the booster (100). Similarly to the embodiments described with reference to FIGS. 1 and 2, the conversion or alteration of the detonation wave from a generally spherical shape to a generally planar shape will increase the booster's (100) explosive output and hence also its effectiveness in initiating the main explosive charge in the blasthole.

Where the booster includes legs to appropriately space the internal member or first explosive substance within the body of the booster, the closure of the booster may include specifically designed grooves or formations into which the legs are inserted and which are capable of retaining the legs. The body may then be filled with the explosive substance or second explosive substance, as the case may be, which is typically in a liquid or gel form, and the closure is then simply secured to the body. Since the legs are attached to the closure, the leg and internal member or first explosive substance will simply be forced into the liquid or gel and thereby locate in the appropriate location within the body. Alternatively, where other means for spacing the internal member or first explosive substance are used, these may first be introduced into the body and the remainder of the body then filled with the explosive substance or second explosive substance as the case may be.

Further alternatively, the explosive substance including the internal member or first explosive substance may of course also be appropriately cast and then simply placed into the body. Various other ways of manufacture and/or assembly may also be employed.

It will be appreciated that although the passage extends centrally into the body in the embodiments illustrated in FIGS. 1, 2, and 4 to 6, it may also be offset from the centre, however, in such a case the shape of the first explosive substance or the shape of the internal member will require adjustment so as to ensure that the detonation wave is appropriately altered to a generally planar wave.

Figures 8, 9:
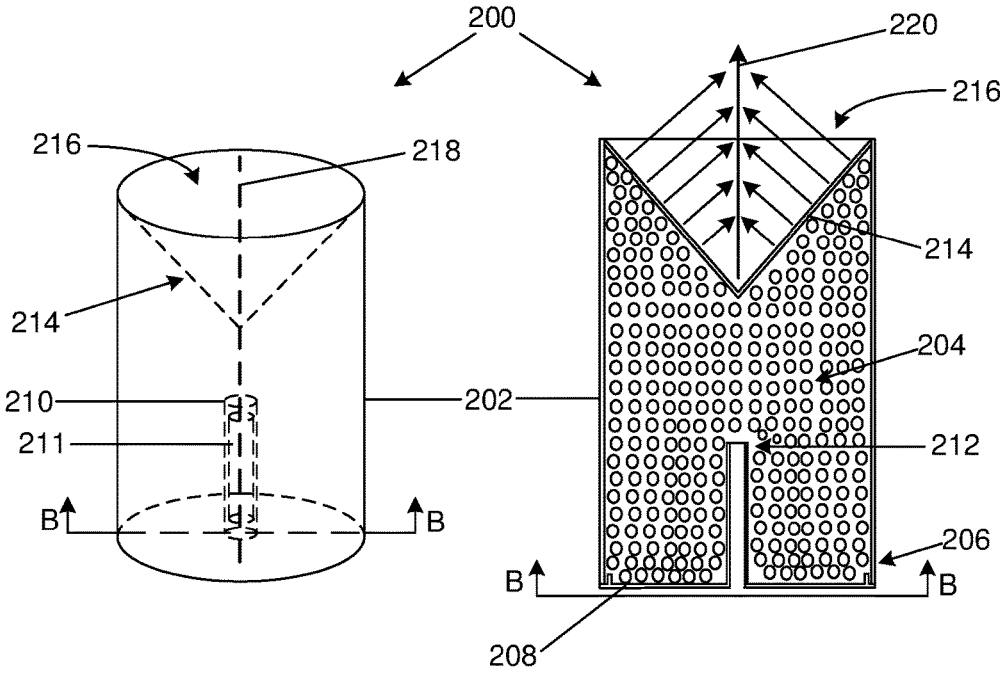
FIG. 8 is a three-dimensional view of yet an even further embodiment of an explosives booster.
FIG. 9 is a longitudinal sectional view of the explosive booster of FIG. 8 along the line B-B.

FIGS. 8 and 9 illustrate yet an even further embodiment of an explosive booster (200) in accordance with the technology. The booster (200) has a cylindrical body (202) that contains an explosive substance (204). The body (202) has an open end (206) to permit the explosive substance (204) to be introduced into the body (202), and which can then be closed by securing a closure (208) thereto. A passage (210) extends from the closure (208) into which a detonator (211) can be inserted, and which extends into the body (202) when secured thereto. The free or output end (212) of the passage (210) is closed, but it may of course also be open and then closed by securing a closure or cap thereto prior to securing the closure (208) to the body (202).

In addition, a wall (214) of the body (202) opposite the open end (206) is shaped to define a hollow (216). The wall (214) defining the hollow (216) is symmetrical about a central axis (218) through the detonator (211) and is configured to impart a lateral component of movement to the detonation wave generated by the explosive substance (204). The hollow (216) in this embodiment has a conical shape, but it may have any suitable generally symmetrical configuration such as a pyramidal, spherical or the like.

In use, when the detonator (211) is initiated, it generates a generally spherical detonation wave which commences initiating the explosive substance (204) held within the body (202). The explosive substance (204) in turn produces a similarly shaped generally spherical detonation wave. The spherical detonation wave propagates through the explosive substance (204) until it reaches the conically shaped wall (214), at which stage the wall (214) imparts a lateral component of movement to the wave, as illustrated in FIG. 9. This is a result of detonation waves always exiting a surface at right angles. Due to the conical shape of the wall (214), the wave will be focussed on a central axis (220) thereby significantly increasing the degree of detonation along that axis (220). Clearly other shapes or configurations of hollows may result in the detonation wave being concentrated on a common focal point.

It will be appreciated that the focused detonation wave generated by the booster will significantly increase the booster's performance due to the substantial increase in temperature and pressure along the axis or point of focus generated by a focused detonation. The increased temperature and pressure in the focused region causes the main explosive charge to overdrive, thus increasing the explosive output and effectiveness of the booster.

Also, it will be appreciated that instead of having a body having a wall which defines the hollow, the explosive substance of the booster could be cast in such a way so as to define the hollow and the explosive substance then simply be placed into a tube having an open end where the hollow locates.

It will further be appreciated that many other embodiments of a booster exist which fall within the scope of the technology, particularly regarding the shape and configuration thereof. For example, the booster may be provided without a body such that the body is in effect made from the explosive or second explosive material, particularly where the explosive material comprises a crystalline or polymerized mass. In addition, the booster may have any suitable shape.

It is also envisaged that in cases where the body is manufactured from a plastics material, that the body is manufactured through a blow-moulding or injection-moulding process and that the plastics material may be reinforced with carbon, glass or other fibres, according to requirement, to ensure that it has adequate strength. Of course, many other methods of manufacturing the body from a plastics material may also be employed.

Furthermore, the body, closure and detonator passage may all form a unitary body with the explosive material being introduced into the body through the passage. Also, the booster could have a suitably shaped rib on an outer surface thereof to enable the booster to be secured to another like booster or an explosive cartridge by means of a snap fit attachment. In addition, in the embodiments illustrated in FIGS. 1, 2 and 4 to 6 extends from the end opposite the closure. The passage may of course also extend from the closure in which case the body is filled with the explosive substance and the closure then secured to the open end by inserting the passage into the explosive substance.

Similarly and with reference to FIGS. 1, 2 and 4, in order to ensure that the first explosive substance is maintained at a desired height or location within the body of the booster, a set of legs similarly to those employed for the internal member illustrated in FIGS. 6 and 7 may be employed. Alternatively, where the first explosive substance is remote from the detonator, as illustrated in FIG. 4, the closure of the body may be provided with suitable attachment formations capable of holding the first explosive substance in position relative to the second explosive substance.

The invention claimed is:

1. An explosives booster shaped to fit into a blasthole in close proximity to a main explosive charge, the explosives booster comprising a body which includes an explosive substance and a passage that extends inwardly from a first end of the body into the explosive substance, the passage being configured to receive therein a detonator for initiating the explosive substance, and wherein a non-explosive member is provided internally of the explosive substance, the non-explosive member being configured to alter the shape of a detonation wave travelling therethrough by decelerating a central portion of the detonation wave relative to a remaining portion of the wave so as to alter the wave from a generally spherical wave to a generally planar wave thereby to increase explosive output of the explosives booster for initiating the main explosive charge in the blasthole.

2. The explosives booster as claimed in claim 1, in which the non-explosive member has a frusto-conical shape.

3. The explosives booster as claimed in claim 1, wherein the body is generally cylindrical in shape.

4. The explosives booster as claimed in claim 1, wherein the explosive substance is selected from a group consisting of pentolite, plastic explosive (C4), octogen (HMX), pentaerythritol tetranitrate (PETN), trinitrotoluene (TNT), cyclotrimethylenetrinitramine (RDX) and any combinations thereof.

5. The explosives booster as claimed in claim 1, wherein the explosive substance is an ammonium nitrate explosive selected from a watergel or slurry explosive, an emulsion explosive, prilled or crystalline ammonium nitrate, liquid ammonium nitrate, any one of the above which includes an additive selected from diesel, oil, a suitable surfactant, liquid or solid molecular explosives and any combination thereof.

6. The explosives booster as claimed in claim 1, wherein the non-explosive member is made from a high density polymer, a low density polymer including expanded polystyrene, bound plastic or glass microballoons, metal, wood or a body defining a hollow void therein.

7. The explosives booster as claimed in claim 1, wherein the non-explosive member locates centrally within the body.

8. The explosives booster as claimed in claim 1, wherein a spacer is provided to space the non-explosive member from a second end of the body.

9. The explosives booster as claimed in claim 8, wherein the spacer includes a set of legs that extend from the non-explosive member.

10. The explosives booster as claimed in claim 1, wherein a second output end of the explosives booster is flat and perpendicular to the axis of the body.

11. The explosives booster as claimed in claim 10, wherein a closure is provided at the output end.

12. The explosives booster as claimed in claim 10, wherein the output end is opposite the first end from which the passage extends inwardly.

13. The explosives booster as claimed in claim 1, including a protective sleeve through which a detonation cable may pass for protecting the detonation cable during insertion of the explosives booster into the blasthole.

14. The explosives booster as claimed in claim 1, wherein the non-explosive member is manufactured from any suitable material capable of decelerating a detonation wave passing therethrough.

* * * * *